US005518087A

United States Patent [19]

Hwang et al.

[11] Patent Number: 5,518,087

[45] Date of Patent: May 21, 1996

[54] RAIL BRAKE APPARATUS FOR A LINEAR MOTOR ELEVATOR

[75] Inventors: Sang Y. Hwang, Seoul; Kil Hee Cho, Kyungsangnam-Do, both of Rep. of Korea

[73] Assignee: LG Industrial Systems Co., Ltd., Seoul, Rep. of Korea

[21] Appl. No.: 299,297

[22] Filed: Sep. 1, 1994

[30] Foreign Application Priority Data

Sep. 11, 1993 [KR] Rep. of Korea ..... 18197/1993
Aug. 9, 1994 [KR] Rep. of Korea ..... 19622/1994

[51] Int. Cl.[6] ..... B66B 5/04

[52] U.S. Cl. ..... 187/374; 188/171

[58] Field of Search ..... 187/288, 359, 187/374, 375, 373; 188/43, 44, 41, 171

[56] References Cited

U.S. PATENT DOCUMENTS 3,160,240 12/1964 Harding, Sr. et al. ..... 188/171
5,014,828 5/1991 Baldassarre ..... 188/43
5,253,738 10/1993 Vertesy et al. ..... 188/171

*Primary Examiner*—Kenneth Noland
*Attorney, Agent, or Firm*—Oliff & Berridge

[57] ABSTRACT

A rail brake apparatus for a linear motor elevator includes mating magnetic cores with coils and spring, brake arms connected with magnetic cores and pivotally engaged with a shaft, linings disposed at both ends of the brake arms for braking a guide rail, thereby reducing the weight of the magnetic units, balancing both magnets in its weight, and obtaining the same pulling force in both magnetic cores. In addition, it further includes a gap maintaining apparatus for maintaining a predetermined gap the upper and the lower magnetic cores, thereby reducing an impact noise occurred during pulling each other and preventing friction due to the slip of the lining, so that the car of the elevator can precisely stop at a desired location.

4 Claims, 7 Drawing Sheets

RAIL BRAKE APPARATUS FOR A LINEAR MOTOR ELEVATOR

BACKGROUND OF THE INVENTION

1. Field of the Invention

The present invention in general relates to a rail brake apparatus for a linear motor elevator, and more particularly to an apparatus that reduces the weight and volume of the magnetic core, reduces the impact noise caused by the magnetic cores, and prevents a slipping of the brake lining, so that a precise stop location of the elevator car can be ensured.

2. Description of the Conventional Art

Among conventional elevator systems, the winding type elevator system is well known and widely diffuse in the industry thereof. The winding type elevator has a structure whereby a machinery room is installed on the upper portion of the elevator, while cables are connected to the elevator car on one end and a counter weight on the other. The disadvantages are that the size of the winding apparatus is fairly large and the braking system including the braking device must be placed within the machinery room, requiting much room for installation. Accordingly, manufacturing and installation cost are high.

In an attempt to resolve these problems, a linear motor elevator that does not requires a separate machinery room attracts attention.

The linear motor elevator does not require a speed reducer since the linear motor directly drives the elevator system, so that a separate machinery room for installing a winding machine is not needed thereby reducing space thereof and the number of the elevator machine parts installed therein.

With reference to the accompanied drawings, the conventional linear motor elevator will now be explained.

As shown in FIG. 1, a stator 2 is disposed between an upper and lower supporting devices 3 and 4. A rotor 6 slidably receiving the stator 2 thereinto is disposed at a counter weight frame 5.

At both sides of the counter weight frame 5 is disposed a weight guide roller 7 being in contact with a counter weight guide rail 8 (hereinafter referred to 'guide rail 8').

The counter weight frame 5 is suspended by the cable 9 connected to the car 11 through a plurality of pulleys 10 and 10'.

On both sides of the car 11 is disposed a car guide roller 12 being in contact with the car guide rail 13.

On both upper and lower portions of the rotor 6 are disposed an air gap adjusting apparatus 14 being in contact with the stator 2 by a predetermined gap and a rotor noise preventing apparatus(not shown).

On the outer portion of the rotor 6 is disposed a cooling device 15. Between the stator 2 and the rotor 6 is disposed an air gap detecting device 16.

In addition, below the counter weight frame 5 is disposed a rail braking device 17. At the upper pulley 10 is disposed a magnetic drum brake 18.

As described above, the conventional linear motor elevator obtains the driving force from a linear motor consisting of the rotor 6 and stator 2 of which the rotor 6 linearly moves along the stator 2 by an inductive magnetic force generated therebetween when electric power is applied to the rotor 6. By the movement of the rotor 6, the car 11 connected to the counter weight frame 5 by the cable 9 linearly moves in an opposite direction of the movement of the counter weight frame 5.

The conventional linear motor elevator is designed to brake the car 11 by friction force generated between the rail brake device 17 and the guide rail 8, using an electromagnet for generating a braking force of the rail brake device 17.

The conventional rail brake device 17 will now be explained.

First, the basic structure of the electromagnet system with reference to FIG. 2 includes an upper magnetic core 21 with a coil 22 disposed therein and a lower magnetic core 23. Here, both magnetic cores 21 and 23 face each other. When electric power is applied to the coil 22, both magnetic cores 21 and 23 approach each other due to the magnetic force generated therebetween. A spring 24 disposed between both magnetic cores 21 and 23 maintain a distance therebetween. Here, when both magnetic cores 21 and 23 approach together or separated from each other, both magnetic cores 21 and 23 move linearly along a guiding shaft (not shown).

As previously described about the structure of the electric magnetic cores 21 and 23, since the coil 22 is disposed around the upper magnetic core 21, it is larger and heavier than the lower magnetic core 23.

In addition, with reference to FIGS. 2 and 3 showing views of a conventional rail brake apparatus using the electromagnetic core, each end of the brake arms 25 and 26 are connected to the upper magnetic core 21 and the lower magnetic core, respectively. At each end of both brake arms 25 and 26 are disposed linings 27 and 28. At an intermediate portion of the brake arms 25 and 26, there is disposed a shaft 29 for connecting both brake arms 25 and 25, thereby both brake arms 25 and 26 pivot at the center of the shaft 29.

Accordingly, the distance between the linings 27 and 28 becomes narrowed as distance between the upper magnetic core 21 and the lower magnetic core 23 become widened, so that the linings 27 and 28 which are disposed near both sides of the guide rail 8 squeeze the guide rail 8 and thus braking the car 11 and stopping it at a desired location. On the contrary, when the distance between the upper magnetic core 21 and the lower magnetic core is narrowed, the distance between the linings 27 and 28 become widened, thus releasing the guide rail 8, so that the car 11 become operational.

Thus, in an operation of the elevator, the magnetic force between the upper magnetic core 21 and the lower magnetic core 23 is generated when electric power is applied to the coil 22. The distance between the upper magnetic core 21 and the lower magnetic core 23 is narrowed, so that the brake arms 25 and 26 pivot at the center of the shaft 29 and thus the distance between the linings 27 and 28 is widened for freeing the guide rail 8.

FIGS. 4 and 5 show a detailed rail brake apparatus shown previously in FIG. 3. It includes a supporting shaft 30 slidably inserted into the upper magnetic core 21 and the lower magnetic core 23, one end of which is connected with one end of the upper brake arm 25 by a shaft pin 31. One end of the lower brake arm 26 is connected to a bracket 32 by a shaft pin 33. The lower magnetic core 23 with the coil 22 is connected to the bracket 32. At the outer surface of the supporting shaft 30 is disposed a spring 24.

In the drawings, the same reference numerals are given in case of the same number shown in FIG. 3. A reference numeral 34 denotes a washer, 35 denotes a power input cable, 36 denotes an output cable, respectively.

As described above, when electric power is applied to the coil 22 for the operation of the elevator, the distance between the upper magnetic core 21 and the lower magnetic core 23 becomes narrowed, compressing the spring 24 inserted onto the supporting shaft 30 and then the brake arms 25 and 26 pivot at the center of the shaft 29, so that the distance between the linings 27 and 28 become widened and then the linings 27 and 28 enable the guide rail 8 to be free. On the contrary, when current is not applied to the coil 22, the distance between the upper magnetic core 21 and the lower magnetic core 23 is widened by the recovering force of the spring 24 inserted onto the supporting shaft 30. As a result, the distance between the linings 27 and 28 becomes narrowed, so that a braking force is applied to the guide rail 8 and thus stopping the elevator.

However, there are difficulties in designing a linear motor elevator directly using an electromagnet as shown in FIG. 2 because the upper magnetic core 21 is heavier than the lower magnetic core 23. This results in a gap difference between the linings 27 and 28 and the rail during braking, which requires appropriate designing.

If the linings 27 and 28 are placed so that their distances to rail 8 are equal, only one lining, namely lining 28 of the lighter lower magnetic core 23 will contact the guide rail during braking. Thus, the distance from the linings 27 and 28 to guide rail 8 must be made differently to insure proper braking operation.

Accordingly, difficult as it may be, even if a design for the guide rail 8 and the linings 27 and 28 with the appropriate distances for proper braking was made possible, interference due to friction between the lining and the rail that has the narrower distance, during normal elevator operation will be a problem.

Therefore, as shown in FIG. 3, in order to employ the conventional magnetic cores for linear motor elevators, the weight of the lighter lower magnetic core must be increased to match that of the heavier upper magnetic core. But, an increase in production expenses, added weight and more need for space all decrease the efficiency of the elevator system.

With reference to FIGS. 4 and 5, the problems are now explained in more detail. The required size and weight of the upper magnetic core 23 is determined according to the number of the winding of the coil 22 for generating a predetermined magnetic force and then the size and weight of the lower magnetic core 21 is determined thereafter.

The distance between the upper and lower magnetic cores 21 and 23 becomes narrowed by the attraction of the magnetic force therebetween when a current is applied to the coil 22 and when a current is not applied to the coil 22 the distance therebetween becomes widened by the recovering force of the spring 24. At this time, if the weight of the upper and lower magnetic cores 21 and 23 are different from each other, the lower magnetic core 23 which has less weight than the upper magnetic core 21 will have more rotating movement force. When current is cut off and the two magnetic cores repel each other, one-sided friction occurs at the lining 27 due to not having the same gap to the center of the guide rail 8. To insure the same gap distance, the upper magnetic core 21 should have a weight equal to that of the lower magnetic core 23 and the coil 22.

However, if the design satisfying the requirements is achieved, the upper magnetic core 21 with no coil 22 should have enough volume compared with the volume needed for the magnetic force density determined at the lower magnetic core 23 with the coil 22, so that the weight of the rail brake apparatus 17 increase while the workability and costs are worsened.

In addition, as shown in FIG. 5, when the upper magnetic core 21 and the lower magnetic core 23 attract each other due to magnetic force that occurs when current is applied to the coil 22, an impact takes place at the inner surface of each of the upper magnetic core 21 and the lower magnetic core 23, making a noise audible during elevator operation.

In addition, when current is applied to the coil 22, the upper magnetic core 21 and the lower magnetic core 23 are separated from each other, a slip between the guide rail 8 and each of the linings 27 and 28 may happen when braking the elevator according to the delayed separation even though the upper magnetic core 21 and the lower magnetic core 23 should be quickly separated from each other. The slip therebetween can be a cause of elevator malfunction.

SUMMARY OF THE INVENTION

It is an object of the present invention to provide an apparatus of resolving the problems of slipping between the linings.

It is another object of the present invention to provide an apparatus for reducing the weight and volume of the magnetic core.

It is still another object of the present invention to provide an apparatus for reducing the impact noise for the magnetic core.

It is still another object of the present invention to provide an apparatus for preventing a slipping of the brake lining so that the car of the elevator can stop precisely at a desired location.

To achieve the objects, the present invention includes a plurality of brake arms pivotally engaged with a shaft including a plurality of linings disposed at each of the two ends of which are used for braking both sides of the guide rail; an upper magnetic core pivotally engaged with the other end of one brake arm and a shaft pin and including a coil disposed at a lower portion thereof and a spring groove formed therein having a predetermined depth; a lower magnetic core pivotally engaged with the other end of another brake arm and a shaft pin and including a coil disposed at an upper portion thereof and a spring groove formed therein having a predetermined depth; a plurality of supporting shafts inserted into each of the grooves of the upper and the lower magnetic cores; and a spring inserted onto the supporting shaft.

The present invention is characterized in that the comers of the magnetic cores are cut for reduction of weight and volume thereof.

The present invention is further provided with a gap maintaining apparatus for keeping a predetermined gap between the magnetic cores.

As an embodiment of the gap maintaining apparatus of an embodiment of the present invention, a gap-piece disposed at an intermediate position of the core guide which passes through the center of the magnetic core is included.

As another embodiment of the gap maintaining apparatus of the present invention, it includes a gap-piece disposed at a shaft inserting groove of the lower magnetic core into which the support shaft connected to the lower brake arm is inserted.

As still another embodiment of the gap maintaining apparatus of the present invention, it includes a gap-piece having a predetermined thickness, that is engaged at a core guide.

PREFERRED EMBODIMENTS OF THE INVENTION

Figure 1:
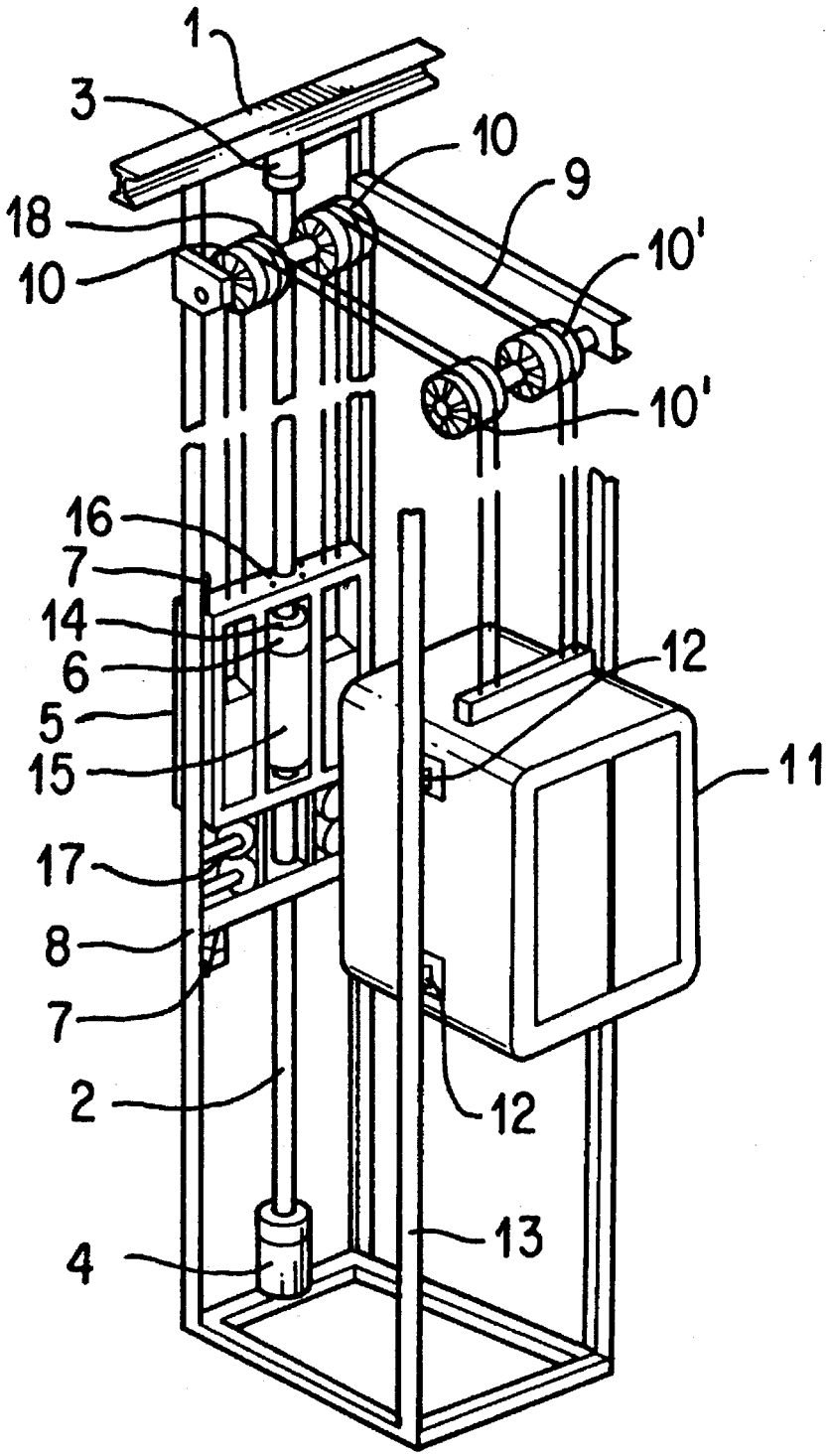
FIG. 1 CONVENTIONAL ART
FIG. 1 is a perspective view showing a conventional linear motor elevator.
Figure 2:
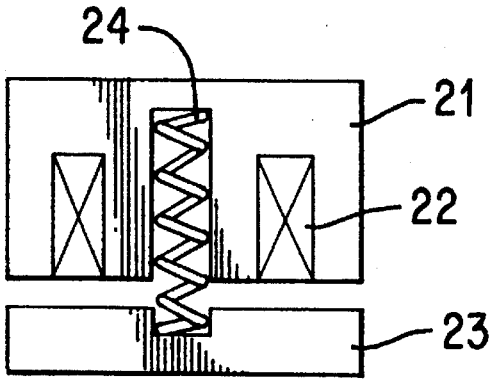
FIG. 2 CONVENTIONAL ART
FIG. 2 is a structural view showing a conventional magnet.
Figure 3:
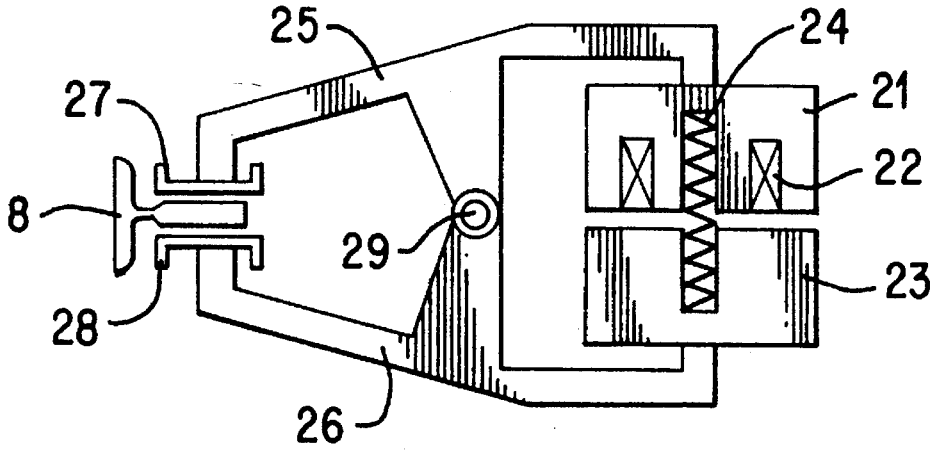
FIG. 3 CONVENTIONAL ART
FIG. 3 is a structural view showing a rail brake apparatus using a conventional magnet.
Figure 4:
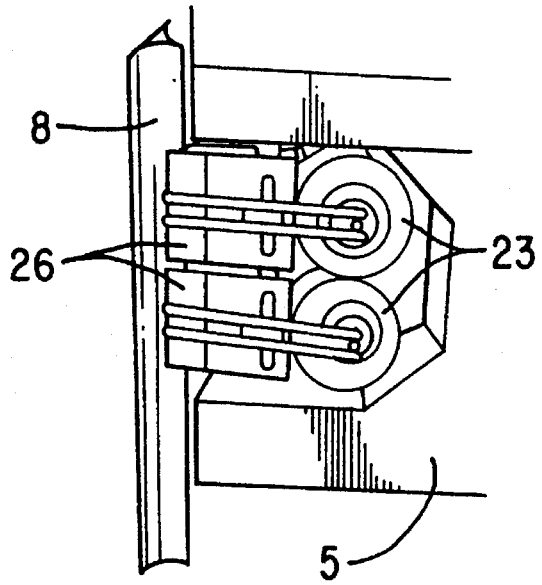
FIG. 4 CONVENTIONAL ART
FIG. 4 is a perspective view showing a rail brake apparatus of a conventional linear motor elevator.
Figure 5:
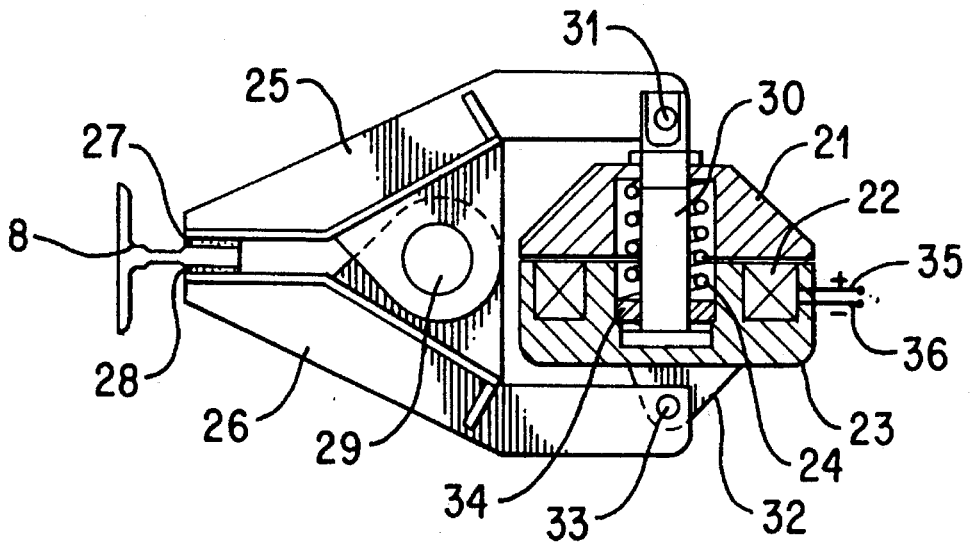
FIG. 5 CONVENTIONAL ART
FIG. 5 is a cross-sectional view showing rail brake apparatus of a conventional linear motor elevator.
Figure 6:
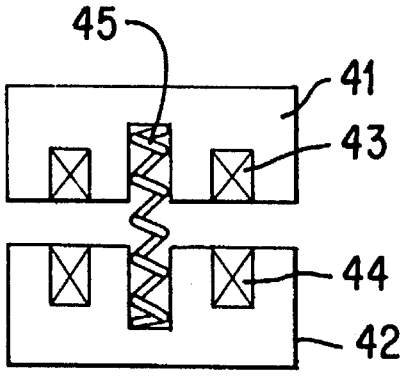
FIG. 6 is a structural view showing a magnet adapted to a rail brake apparatus of the present invention.

With reference to FIG. 6, a magnet adapted to a rail brake apparatus of a linear motor elevator according to the present invention is shown. It includes a plurality of coils 43 and 44 disposed at the upper and lower magnetic cores 41 and 42, and a spring 45 disposed between the upper and the lower magnetic cores 41 and 42.

Figure 7:
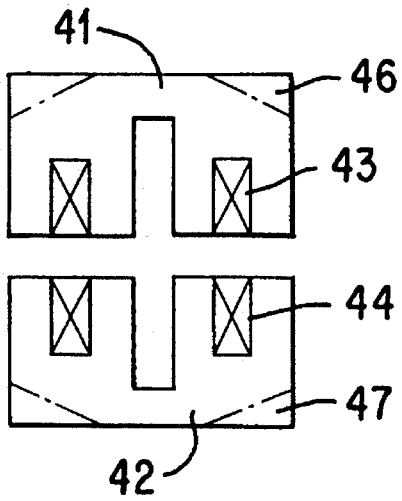
FIG. 7 is a structural view showing a magnet according to an embodiment adapted to a rail brake apparatus of the present invention.

Meanwhile, as shown in FIGS. 6 and 7, as an embodiment for reducing the weight of the magnet, there are cut portions 46 and 47 on the upper and lower magnetic cores 41 and 42, so that the weight and volume thereof can be reduced.

Figure 8:
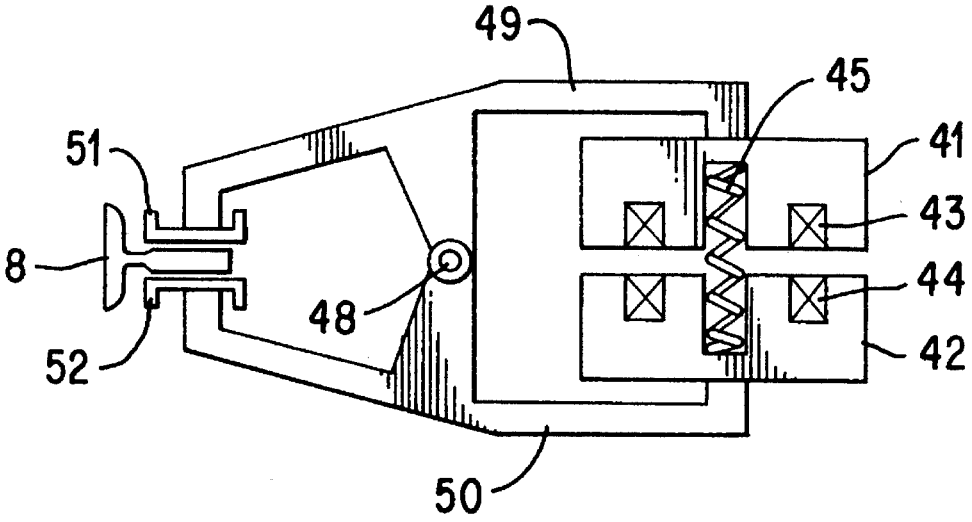
FIG. 8 is a structural view showing a rail brake apparatus of a linear motor elevator according to an embodiment of the present invention.

With reference to FIG. 8, there is shown a rail brake apparatus of the linear motor elevator according to the present invention. It includes the upper and lower magnetic cores 41 and 42 equipped with the coils 43 and 44 and the spring 45 disposed therebetween, an upper brake arm 49 and a lower brake arm 50 which are connected with the upper and lower magnetic cores 41 and 42, respectively, and pivotally connected with a shaft 48 disposed at the center portion thereof, and a plurality of linings 51 and 52 disposed at the ends of both brake arms 49 and 50 for selectively braking the guide rail 8.

Thus, the rail brake apparatus of the linear motor elevator according to the present invention is provided to obtain a predetermined pulling force between the upper and the lower magnetic cores 41 and 42 by providing the coils 43 and 44 at both sides thereof thereby reducing the weight and volume thereof and balancing it, while resolving the problems of winding the coils 43 and 44.

An operation of the rail brake apparatus of the linear motor elevator according to the present invention will now be explained.

During the operation of an elevator, magnetic force takes place at the coils 43 and 44 due to the applied current. The distance between the upper and lower magnetic cores 41 and 42 becomes narrowed due to the magnetic force and then the brake arms 49 and 50 pivot at the center of the shaft 48. Following the rotating movement of the brake arms 49 and 50, the distance between the linings 51 and 52 is widened from the guide rail 8.

In addition, as the elevator stops, the current supply is terminated and the pulling force between the upper and lower magnetic cores 41 and 42 disappears, so that the distance between the upper and the lower magnetic cores 41 and 42 become widened and then the distance between the linings 51 and 52 becomes widened due to the recovering force of the spring 45, which then makes the distance between the linings 51 and 52 approach and thereby braking the guide rail 8.

As described above, the brake apparatus according to the present invention is provided with a plurality of coils 43 and 44 disposed at both inner surfaces of the upper and lower magnetic cores 41 and 42, respectively, thereby reducing the volume of the rail brake apparatus and minimizing the weight thereof.

Meanwhile, the brake apparatus according to the present invention further includes a gap maintaining device disposed between the inner surface of the upper and lower magnetic cores 41 and 42 in order to prevent bumping that occurs when both upper and lower magnetic cores 41 and 42 approach each other and to prevent a slipping of the elevator caused by the existing current at the coils 43 and 44.

Figure 9:
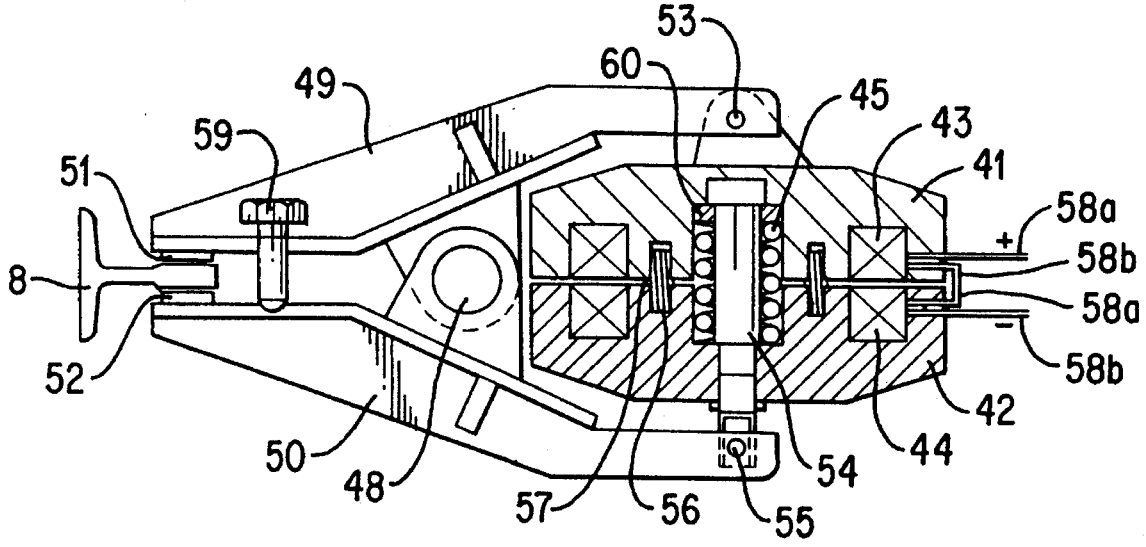
FIG. 9 is a cross-sectional view showing a rail brake apparatus of a linear motor elevator according to another embodiment of the present invention.
Figure 10A:
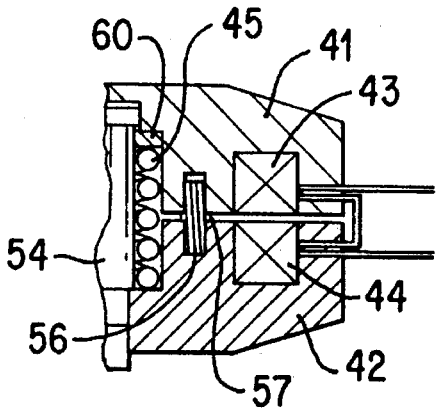
FIG. 10A is a partial cross-sectional view showing a state of being narrowed between an upper magnetic core and a lower magnetic core in an operation of the rail brake apparatus of the linear motor elevator according to another embodiment of the present invention and FIG. 10B is a partial cross-sectional view showing a state of being spaced therebetween.
Figure 10B:
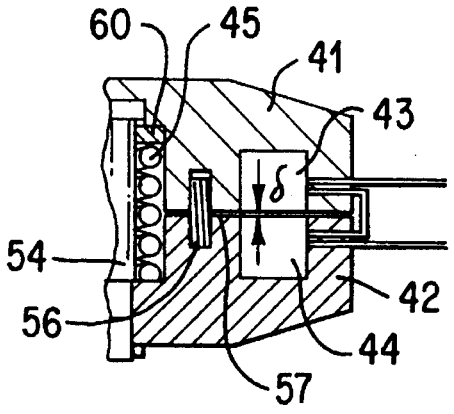

With reference to FIG. 9, there is shown a rail brake apparatus of the linear motor elevator equipped with the gap maintaining device according to an embodiment of the present invention. It includes an upper magnetic core 41 connected with one end of an upper brake arm 49 by a shaft pin 53 and a lower magnetic core 42 connected with one end of a lower brake arm 42 by shaft pin 55 which is connected with a supporting pin 54 inserted into the center portion of the upper and the lower magnetic cores 41 and 42. At the supporting shaft 54 is disposed with a spring 45. A plurality of coils 43 and 44 are respectively disposed inside the upper and lower magnetic cores 41 and 42.

The gap maintaining device is a gap-piece 57 engaged at a core guide 56 and disposed between the inner surface of the upper and lower magnetic cores 41 and 42, having a predetermined thickness.

The gap-piece is preferably made of non-conductive materials and the thickness thereof should be kept at in dimension to a level of preventing the generation of the existing current.

The core guide 56 for guiding the upper and the lower magnetic cores 41 and 42 is made of a non-magnetic materials.

The gap-piece 57 can be integrally formed with the core guide 56 or can be separately formed and then affixed thereto, in addition, it can be integrally formed with the upper and the lower magnetic cores 41 and 42 without using an additional core guide 56.

In addition, as for the power supply to the coils 43 and 44, the input coil cable 58*a* is connected to the upper magnetic core 41 and wound around it and then connected to the output coil cable 58*b*. The output coil cable 58*b* is connected to the input coil cable 58*a* of the lower magnetic core 42 and wound around it and then connected to the output coil cable 58*b*.

In addition, at a predetermined portion of the upper brake arm 49, close to the linings 51 and 52, a bolt 59 coupled for controlling the distance between the upper brake arm 49 and the lower brake arm 50 by rotating the bolt is disposed.

The numeral reference 60 not described in the drawings denotes a washer.

The operation of the rail brake apparatus of the linear motor elevator according to an embodiment of the present invention will now be explained.

When the power supply is applied to the upper and lower magnetic cores 41 and 42, a pulling force, between the surfaces of each of the upper and lower magnetic cores 41 and 42 occurs since the upper and lower magnetic cores 41 and 42 have the same winding direction and the number of coil windings. At this time, the upper and lower magnetic cores 41 and 42 attracts each other until the attracting force is beyond the pressuring force of the spring disposed at the center portion of each of the upper and lower magnetic cores 41 and 42. Here, the supporting shaft 54 moves by a distance of the displacement of the spring 45 and then the upper and lower magnetic cores 41 and 42 approach one another in a guide of the core guide 56 of the non-magnetic materials.

At this time, since the gap-piece 57 is disposed between the upper and lower magnetic cores 41 and 42, the inner surface of each of the upper and lower magnetic cores 41 and 42 is in contact with each other by a distance of the thickness of the gap-piece 57.

Accordingly, noise created by an impact between the upper and lower magnetic cores 41 and 42 can be prevented, in case of the power-off, the friction that occurs due to the slip of the linings 51 and 52 is prevented and the car 11 of the elevator can stop at a desired location since the upper and lower magnetic cores 41 and 42 quickly become separated from each other due to the recovering force of the spring and then the linings 51 and 52 of the brake arms 49 and 50 brakes the guide rail 51 by the pivot of the brake arms 49 and 50.

Figure 11:
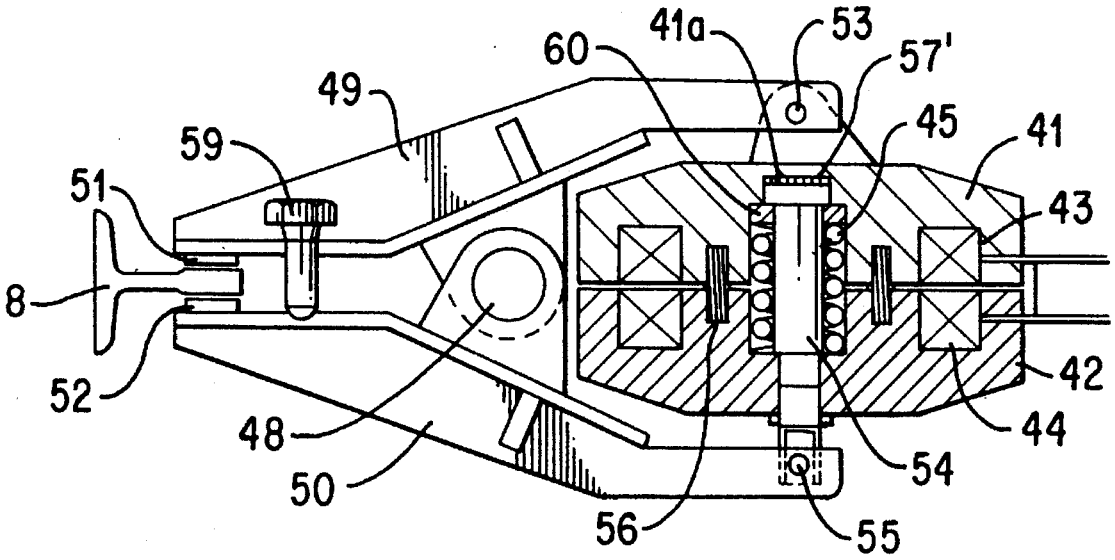
FIG. 11 is a cross-sectional view showing a rail brake apparatus of the linear motor elevator according to further another embodiment of the present invention.

Meanwhile, FIG. 11 shows a rail brake apparatus of the linear motor elevator with a gap maintaining device according to another embodiment of the present invention, including a gap-piece 57' disposed at one end portion of a shaft inserting groove 41*a* of the upper magnetic core 41 having a thickness greater than the gap for preventing a generation of the existing current.

The gap-piece 57' is preferably made of non-magnetic materials.

Figure 12A:
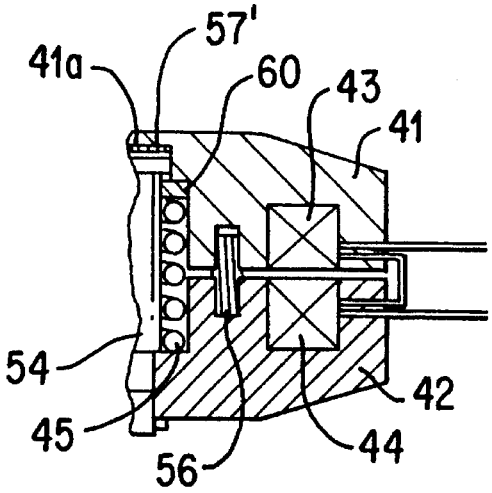
FIG. 12A is a partial cross-sectional view showing a state of being narrowed between an upper magnetic core and a lower magnetic core in an operation of the rail brake apparatus of the linear motor elevator according to a still another embodiment of the present invention and FIG. 12B is a partial cross-sectional view showing a state of being spaced therebetween.
Figure 12B:
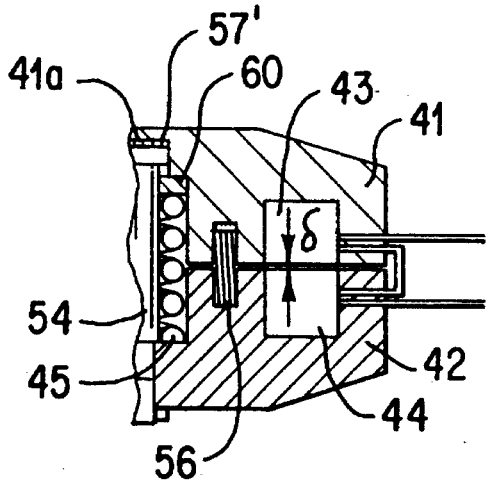

The operation of another embodiment of the rail brake apparatus of the linear motor will now be explained. With reference to FIGS. 12A and 12B, when the power supply is applied to the upper and lower magnetic cores 41 and 42, the distance between the upper and lower magnetic cores 41 and 42 becomes narrowed in a guide of the core guide 56, as being beyond the elasticity of the spring 45. At this time, since the gap-piece 57' is engaged at one end portion of the shaft inserting groove 41*a* of the upper magnetic core 41, the car 11 of the elevator can stop at the desired location without slipping, absorbing the impact noise by allowing the upper portion of the supporting shaft 54 to hit the gap piece 57' in a state of leaving a gap of the existing magnetic prevention between the upper and lower magnetic cores 41 and 42, at the same time preventing friction due to the slip of the linings 51 and 52.

The gap-pieces 57 and 57' have the exact same purpose of installation and operation, except for the location of installation, thus a duplicate description will be omitted.

Figure 13:
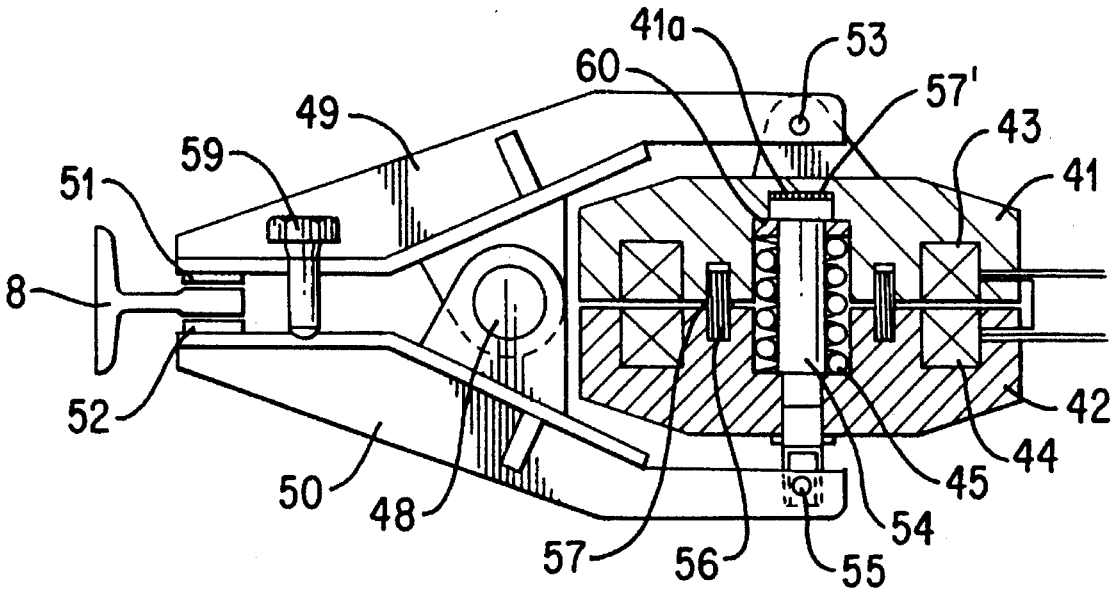
FIG. 13 is a cross-sectional view showing a rail brake apparatus of the linear motor elevator according to a still another embodiment of the present invention.
Figure 14:
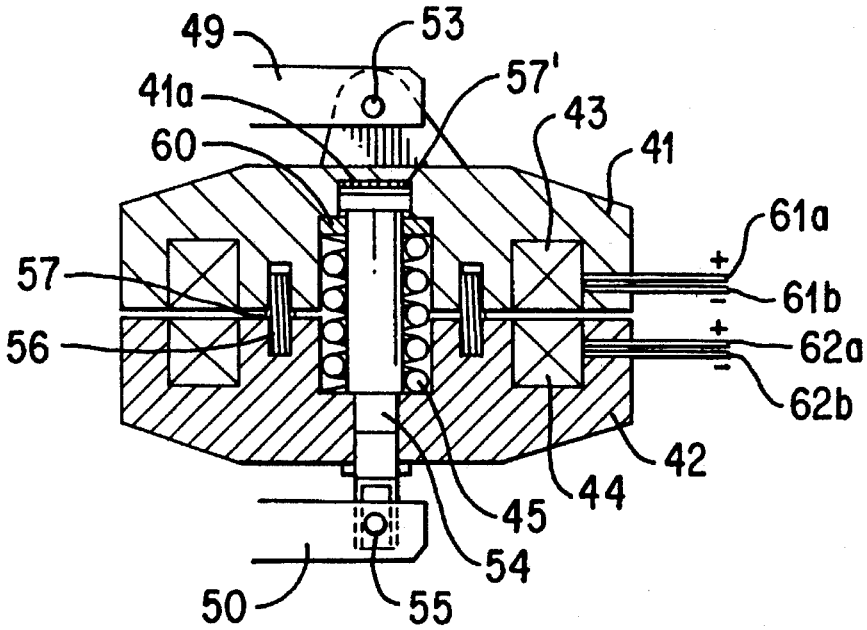
FIG. 14 is a cross-sectional view showing another embodiment of a coil current applying structure of a rail brake apparatus of the linear motor elevator according to the present invention.

Meanwhile, FIG. 13 shows a rail brake apparatus of the linear motor elevator with a gap maintaining device according to still another embodiment of the present invention, including an input coil 61*a* and an output coil 62*a* of the upper magnetic core 41 connected to the coil 43 and an output coil 61*b* and an output coil 62*b* of the lower magnetic core 42 connected to the coil 44.

Accordingly, the effects of the rail brake apparatus of the linear motor elevator according to the present invention will now be explained.

By installing the coils to both the upper and lower magnetic cores, a weight balance of both magnetic cores can be achieved thereby. The noise caused by the impact of both cores during attracting can be prevented, and the friction due to the slip of the linings can be also prevented by allowing a predetermined gap between the upper and lower magnetic cores.

What is claimed is:

1. A rail brake apparatus for a linear motor elevator, comprising:

a plurality of brake arms pivotally engaged with a shaft and each including a plurality of linings disposed at one end thereof for braking both sides of a guide rail;

an upper magnetic core pivotally engaged with another end of one of said brake arms and having a spring groove having a predetermined depth and formed therein;

a lower magnetic core pivotally engaged with another end of another of said brake arms and having a spring groove having a predetermined depth and formed therein;

at least one coil, disposed either at one or both of a lower portion of said upper magnetic core and an upper portion of said lower magnetic core;

gap maintaining means for maintaining a predetermined gap between the upper magnetic core and the lower magnetic core;

a plurality of supporting shafts inserted into each of the spring grooves of the upper and lower magnetic cores; and a spring inserted onto the supporting shaft.

2. The apparatus of claim 1, wherein said gap maintaining means is a gap-piece engaged to a core guide, having a predetermined thickness and disposed between the inner surfaces of both magnetic cores.

3. The apparatus of claim 1, wherein said gap maintaining means is another gap-piece engaged at an end portion of a shaft inserting groove of the upper magnetic core, where the supporting shaft of which one end is connected to the brake arm is inserted thereinto.

4. The apparatus of claim 1, wherein said gap maintaining means includes a gap-piece engaged to a core guide, having a predetermined thickness and disposed between the inner surfaces of both magnetic cores and another gap-piece engaged at an end portion of a shaft inserting groove of the upper magnetic core, where the supporting shaft of which one end is connected to the brake arm is inserted thereinto.

* * * * *